US005464115A

United States Patent [19]

Tisbo et al.

[11] Patent Number: 5,464,115

[45] Date of Patent: Nov. 7, 1995

[54] MOLDED PLASTIC FOOTLOCKER

[75] Inventors: Thomas A. Tisbo, Barrington Hills; Stephen P. Whitehead, Elgin; Michael G. Uffner, Naperville, all of Ill.

[73] Assignee: Suncast Corporation, Batavia, Ill.

[21] Appl. No.: 285,922

[22] Filed: Aug. 3, 1994

[51] Int. Cl.[6] ..... B65D 45/16

[52] U.S. Cl. ..... 220/324; 16/286; 16/306; 16/337; 190/39; 206/508; 220/335; 220/671; 220/675; 220/770; 292/281

[58] Field of Search ..... 206/508; 220/671, 220/335, 324, 908, 770, 469, 675; 292/282–287, 281; 70/54, 56; 190/39, 25, 101, 127, 119–121, 40; 16/306, 337, 286

[56] References Cited

U.S. PATENT DOCUMENTS

| | | | |
|---|---|---|---|
| D. 329,331 | 9/1992 | Hobson . | |
| D. 329,747 | 9/1992 | Embree . | |
| D. 334,662 | 4/1993 | van Berne . | |
| D. 342,609 | 12/1993 | Brightbill . | |
| 1,700,086 | 1/1929 | Sherwood | 16/286 X |
| 2,347,192 | 4/1944 | Grice | 190/37 |
| 3,379,341 | 4/1968 | Miles | 206/508 |
| 3,966,084 | 6/1976 | Box | 220/326 |
| 3,977,712 | 8/1976 | Northrop | 16/84 X |
| 3,987,829 | 11/1976 | Leone | 220/675 X |
| 4,466,541 | 8/1984 | Tabler et al. | 220/338 X |
| 4,486,917 | 12/1984 | Johnston et al. | 16/337 |
| 4,523,692 | 6/1985 | Lemkin | 220/306 |
| 4,789,078 | 12/1988 | Miller et al. | 220/335 |
| 4,863,062 | 9/1989 | Holliday | 220/338 |
| 4,896,518 | 1/1990 | Appelgren | 70/54 |
| 4,899,420 | 2/1990 | Bye et al. | 16/306 X |
| 5,133,472 | 7/1992 | Koda et al. | 220/770 X |
| 5,163,204 | 11/1992 | Jackson | 16/84 |
| 5,193,706 | 3/1993 | Hanna et al. | 220/324 |

*Primary Examiner*—Allan N. Shoap
*Assistant Examiner*—Robin A. Hylton
*Attorney, Agent, or Firm*—McHale & Slavin

[57] ABSTRACT

The present invention is a footlocker of molded plastic construction which includes a bin having a storage cavity and a lid hinged to the bin for enclosing the storage cavity. Two plastic latches are used to secure the lid in its closed relation above the bin. Each of the latches includes a face plate with a front surface which preferably has graphic indicia molded therein. In order to lock the lid in its closed position and thereby safeguard the contents of the bin, the footlocker preferably includes a padlock hasp. In order to hold the lid open in any position, the footlocker includes a lid stay mechanism connected between the lid and the bin. The bin has a plurality of continuously molded feet and the top surface of the lid a plurality of stacking depressions molded therein for receiving the feet and thereby enabling multiple footlockers to be stacked on top of one another. The top surface of the lid preferably has graphic indicia molded therein for enhancing the aesthetic qualities of the footlocker, and may include an area operatively adapted to receive indicia. The front surface of the bin may also have an area operatively adapted to receive indicia.

16 Claims, 6 Drawing Sheets

MOLDED PLASTIC FOOTLOCKER

FIELD OF THE INVENTION

The present invention relates generally to the field of storage devices, and more particularly to a molded plastic storage footlocker.

BACKGROUND OF THE INVENTION

Footlockers are defined by Webster's Encyclopedic Unabridged Dictionary as a small trunk for containing the personal affects of a soldier and kept at the foot of his bed. However, it is well known that footlockers may be used for many other purposes such as storing children's toys, sport equipment, books, clothing and other personal affects, and the footlocker may be placed at locations other than the foot of a bed.

Footlockers are typically constructed from sheet metal providing structural strength with minimal weight. A problem with sheet metal construction is that the thin metal tends to have sharp edges that are difficult to assemble without causing injury. Metal footlocker construction requires assembly by welding or with fasteners such as bolts and rivets which must be painted to prevent corrosion. Should the sheet metal construction or fasteners flex, the result is a stressing of the paint leading to cracks or the like premature degradation.

Footlockers may also be constructed of wood such as cedar. Wood is subject to rot from insect attack and moisture, especially if placed directly on a cement floor. A well crafted footlocker utilizes individual pieces of wood cut to size and assembled with glue causing an expense in manufacturing. Once assembled the wood footlockers are painted or stained to improve their appearance which further adds to the expense of manufacture.

Both metal and wood footlockers commonly form the shape of a rectangular trunk having a hinged lid. A hasp may be used to secure the lid and a padlock may be employed to safeguard the contents of the footlocker. The hasp is secured in place with fasteners embedded in the lid and box which is easily unfastened compromising the security of the footlocker. Yet another problem with conventional footlockers is directed to the lid which must be held open while the contents of the footlocker are being retrieved. A person desirous of retrieving the contents from a footlocker will use one hand to hold the lid in a raised position while the contents of the footlocker are retrieved with the other hand. This is difficult for small children.

Therefore, there is a need for a lightweight footlocker which is relatively inexpensive to manufacture, assemble and maintain and retains its aesthetic qualities without need of painting or staining. There is also a need for a footlocker with an improved means for securing its contents from unwanted intrusion, and having a means for maintaining the lid in a raised position while the contents of the footlocker are retrieved.

SUMMARY OF THE INVENTION

The present invention satisfies the aforementioned needs through provision of a footlocker molded from plastic. The footlocker having a bin with a storage cavity and a lid hinged to the bin for enclosing the storage cavity. The lid includes a peripheral groove adapted to receive an upper edge of the bin when the lid is placed in a closed position. A plurality of continuously molded feet protruding out of the bottom surface of the bin operate to maintain the bottom surface a fixed distance from a floor surface, a top surface of the lid includes stacking depression molded into the top surface of the footlocker allowing footlockers of the same design to be stacked on top of each other wherein the feet from the bottom surface engage the stacking depression on the lid. The lid and bin have areas provided for receipt of personalized graphic indicia surrounded by graphic indicia which is hot-stamped into the plastic.

Two plastic latches are used to secure the lid to the bin in a closed position. Each latch includes a surface having graphic indicia molded thereon so that the top surface of the lid and the front surface of each latch provide an ornamental display having aesthetic appeal. Each latch includes a hinged end which is pivotally connected to a front surface of the bin, a locking end of the face plate is engagable with a raised ridge formed in the front surface of the lid. The hinged end of the face plate is pivotally connected by use of a double jointed pivot having a first hinge pin spaced in a substantially parallel relation to a second hinge pin which enables a lip of the locking end of the face plate to be hooked behind a corresponding ridge to secure the lid in a closed position.

An integrated hasp has an upper bracket protruding outwardly from the front surface of the lid and a lower bracket which protrudes outwardly from the front surface of the bin. Each bracket includes a hole formed therethrough so that when the lid is in a closed position the brackets allow a padlock shackle to be passed through each hole securely locking the lid to the bin, thereby safeguarding the contents of the bin.

A lid stay mechanism is provided which assists in raising the lid and holding the lid in an open position. The lid stay mechanism is coupled between the lid and the bin and includes a spring loaded piston shaft in a tubular housing providing a biasing means.

Thus, an objective of the present invention is to provide an inexpensive durable footlocker constructed of plastic which does not require painting or staining and includes hot-stamped graphic indicia to enhance its aesthetic appearance.

An additional objective of the present invention is to provide a footlocker that is resistant to unauthorized intrusion by use of an integrated hasp bracket thereby increasing the integral strength of the hasp.

Another objective of the present invention is to provide a footlocker with a stay lid mechanism that will assist in opening and maintaining the lid in an open position to assist young children in gaining access to the contents of the footlocker.

Yet still another objective of the present invention is to provide a footlocker having an area for placement of personalized graphic indicia.

The above and other objectives, features, and advantages of the present invention will become apparent upon consideration of the detailed description and the appended drawings.

DETAILED DESCRIPTION OF THE INVENTION

Although the present invention is herein described in terms of a specific embodiment, it will be readily apparent to those skilled in this art that various modifications, rearrangements, and substitutions can be made without departing from the spirit of the invention. The scope of the present invention is thus only limited by the claims appended hereto.

Figure 1:
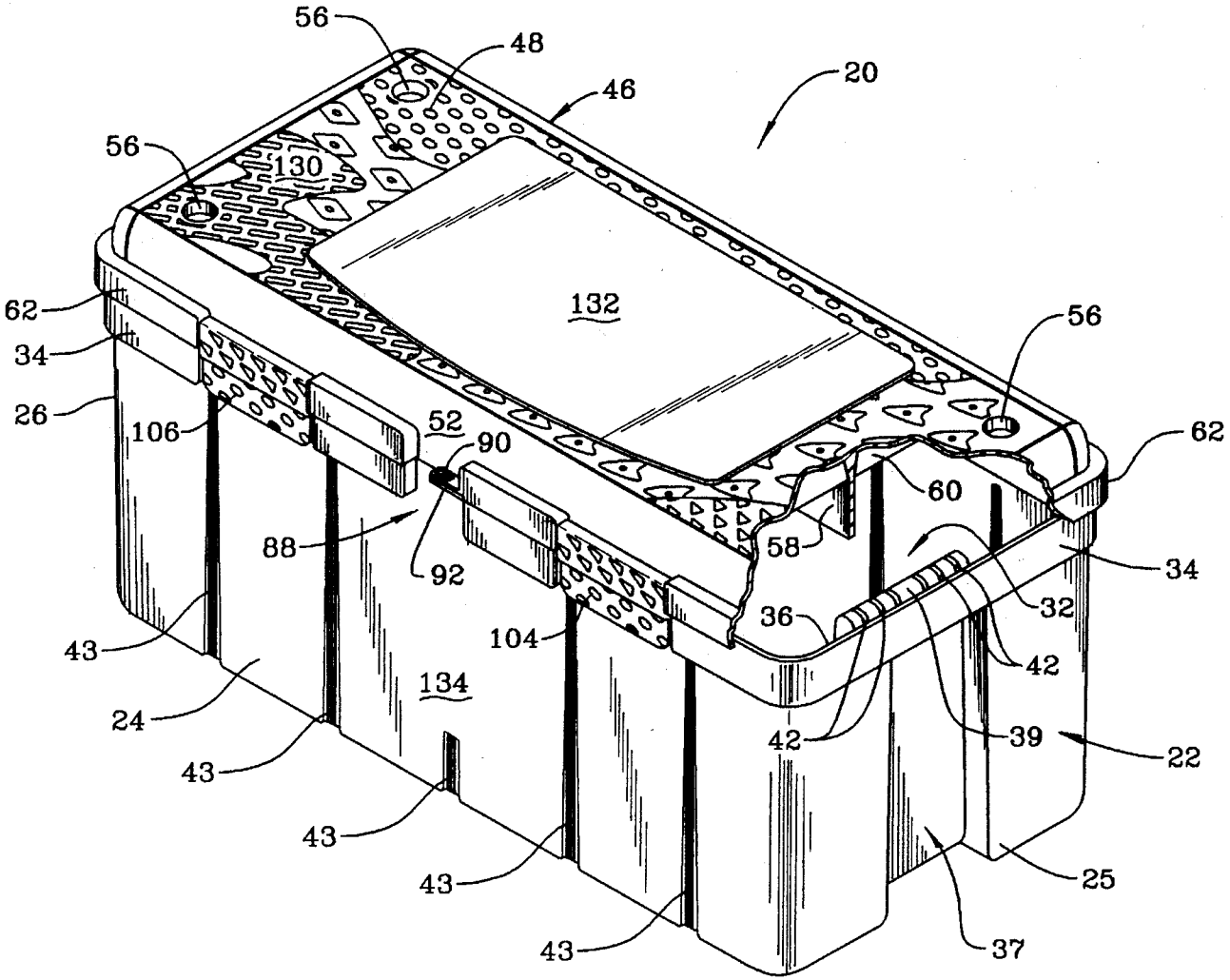
FIG. 1 is a partially broken away perspective view of one embodiment of the present footlocker.
Figure 2:
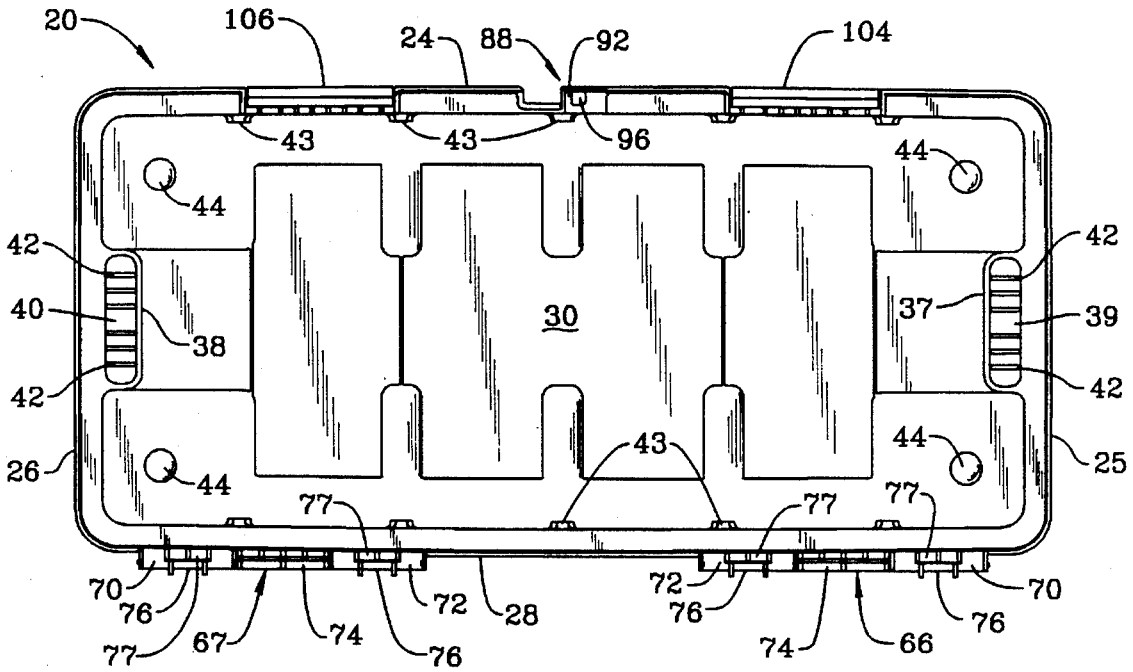
FIG. 2 is a bottom view of the footlocker of FIG. 1.
Figure 3:
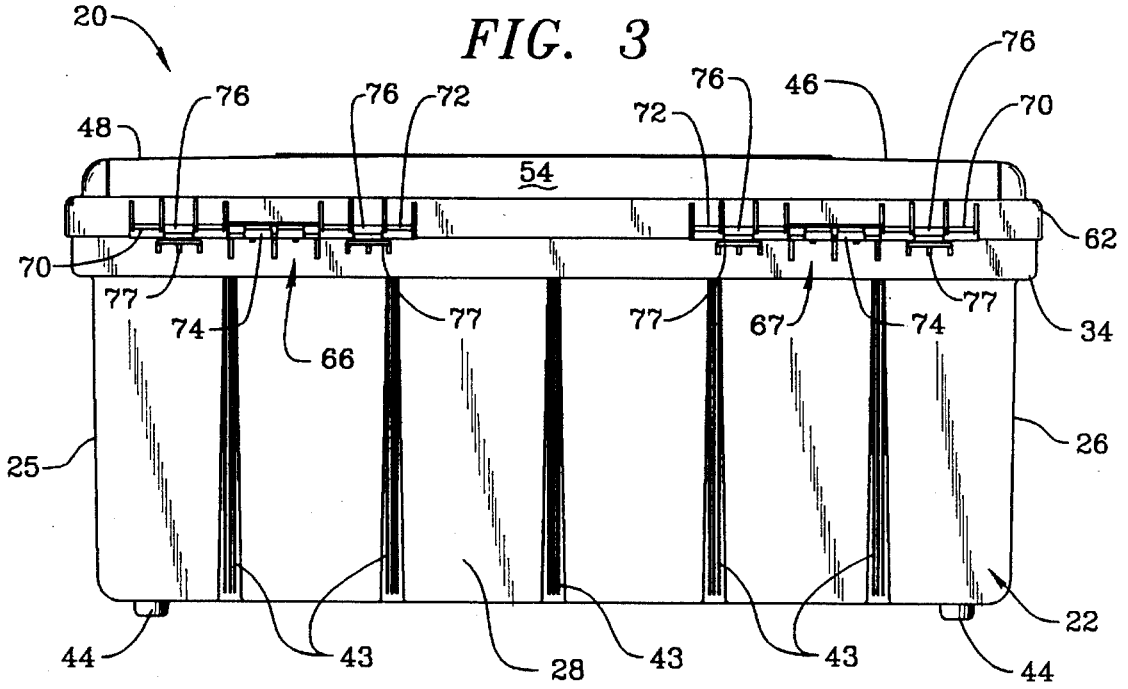
FIG. 3 is a rear view of the footlocker of FIG. 1.

Referring to FIGS. 1–3, a plastic footlocker 20 according to the present invention includes an injection molded plastic bin 22 with a front surface 24, a right side surface 25, a left side surface 26, a rear surface 28, and a bottom surface 30 forming a storage cavity 32. Bin 22 has a first peripheral rim 34 with an upper edge 36, forming an opening to the storage cavity 32. Each of the side surfaces 25 and 26 have a vertical channel 37 and 38 respectively formed therein. Each channel 37 and 38 leads up to a continuously molded handle 39 and 40 recessed into the first rim 34. Each handle 39 and 40 has a plurality of air vent slots 42 continuously molded therein. Ribbed channels 43 are also formed vertically across the front surface 24 and rear surface 28 of the bin 22. The rim 34, channels 37, 38 and ribbed channels 43 provide bin 22 with structural support and durability that allows thinner plastic panels to be used. The bin 22 rests upon four continuously molded feet 44 protruding below its bottom surface 30.

Footlocker 20 also includes an injection molded plastic lid 46 hinged to the bin 22 for covering over the opening to storage cavity 32 formed by upper edge 36. Lid 46 includes a top surface 48, an underside surface 50, a front surface 52 and a rear surface 54. The top surface 48 has four stacking depressions 56 molded therein, with each depression 56 being operatively adapted to permit the feet 44 of another bin to nest therein and enable a plurality of footlockers 20 to be securely stacked on top of each other. The underside 50 of lid 46 has at least one first or longitudinal rib 58 continuously molded along its length and a plurality of second or transverse ribs 60 continuously molded along its width. The lid 46 also includes a second peripheral rim 62 having a groove 64 operatively adapted to receive the upper edge 36 of the bin 22 (see FIG. 4), when the footlocker 20 is closed. Other than that provided by its injection molded continuous construction, rim 62 and ribs 58, 60 provide additional structural support and durability to lid 46.

Referring to FIGS. 2 and 3, two spaced hinges 66 and 67 are used to pivotally connect the lid 46 to the upper rim 34 of the bin 22. Each hinge 66 and 67 includes a pair of spaced first hinge elements 70 and 72 formed as a continuously molded part of the peripheral rim 62 on the rear surface 54 of the lid 46. Each hinge 66 and 67 also includes a second hinge element 74 formed as a continuously molded part of the peripheral rim 34 on the rear surface 28 of the bin 22. Lid 46 and bin 22 are pivotally connected together by operatively disposing a hinge pin 75 through the hinge elements 70, 72 and 74 of each hinge 66 and 67. By being hinged in this manner, lid 46 can be lifted or lowered to open or close footlocker 20 as desired. Each first hinge element 70 and 72 includes a first stop bracket 76 as a continuously molded part thereof. Each first bracket 76 is operatively adapted to contact a continuously molded second stop bracket 77 formed on the first rim 34 of bin 22 when lid 46 is lifted to its fully opened position (see FIG. 5). In this way, lid 46 will not fall backwards when fully opened. Thus, brackets 76 and 77 act as stops to limit the extent lid 46 can be opened.

Figure 4:
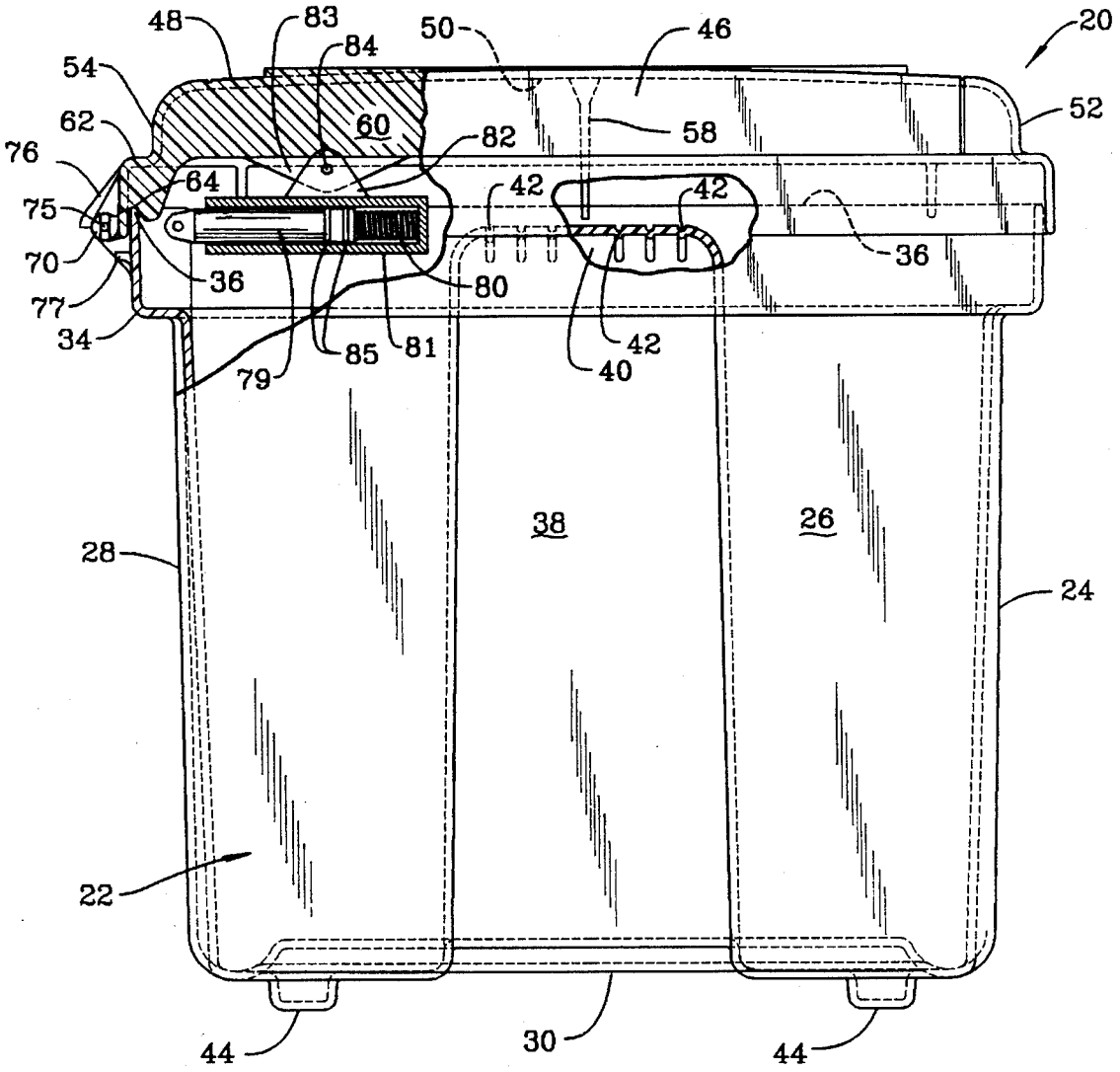
FIG. 4 is a partially broken away left side view of the footlocker of FIG. 1, with its lid fully closed.
Figure 5:
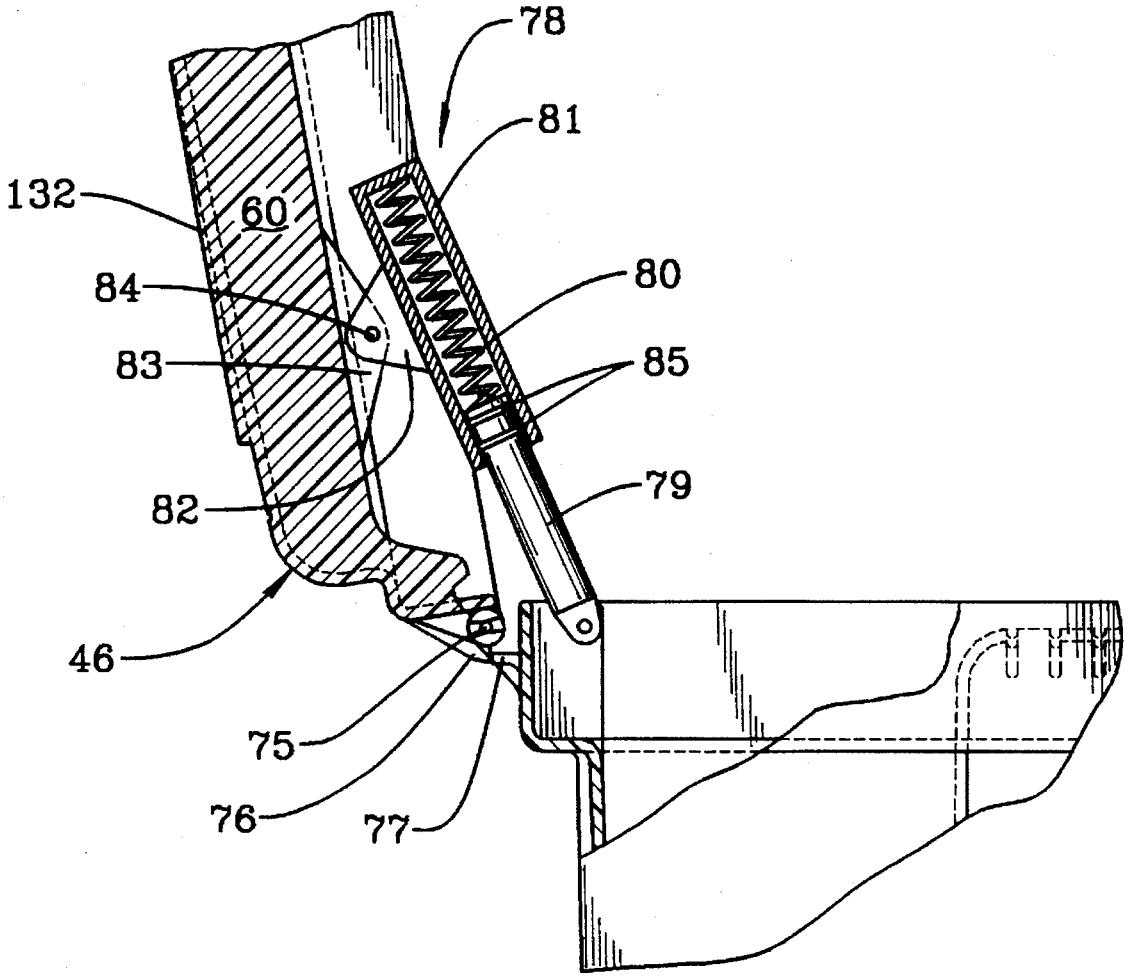
FIG. 5 is a partially broken away left side view of the footlocker of FIG. 1, with its lid fully open.

Referring to FIGS. 4 and 5, footlocker 20 preferably includes one or more lid stay mechanisms 78 for holding the lid 46 in any open position desired between closed and fully opened. Each exemplary lid stay 78 includes a piston shaft 79 that is spring loaded with a compression coil spring 80 into a tubular housing 81. Coil spring 80 is compressed between a backwall of housing 81 and a leading end of piston 79. The housing 81 and piston 79 of each lid stay 76 are pivotally mounted to the rear of lid 46 and bin 22, respectively, inside of footlocker 20. Each housing 81 mounts a yoke 82 pivotally connected to a hinge plate portion 83 of a transverse rib 60 with a hinge pin 84. The rear end of piston 79 is similarly hinged to the inside of first rim 34 in the rear of bin 22. Spring 80 provides a positive biasing force for lifting lid 46 when opening footlocker 20. Each of at least one and preferably two rubber O-rings 85 is operatively disposed in a groove formed circumferentially around the outside of piston 79. Each O-ring 85 is dimensioned to extend beyond the outer surface of piston 79 and contact the inside surface of housing 81. The O-rings 85 are in sufficient contact with the inside surface of housing 81 to generate frictional forces and pneumatic resistance as piston 79 moves in and out housing 81. The frictional forces and pneumatic resistance so generated by O-rings 85 are sufficient to counteract the force exerted by spring 80 in opening lid 46 from its closed position (see FIG. 4) to its fully opened position (see FIG. 5). In this way, lid 46 can be held in any open position in which it is lifted.

Figure 6:
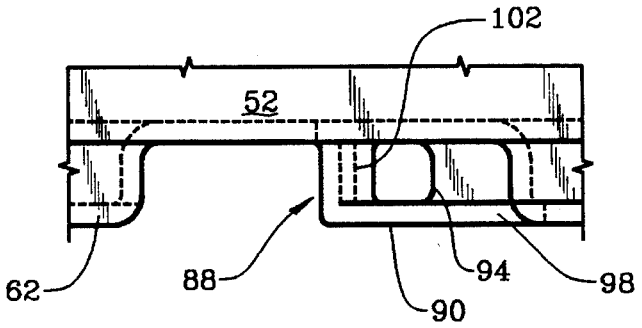
FIG. 6 is an enlarged top plan view of the padlock hasp of the footlocker of FIG. 1.
Figure 7:
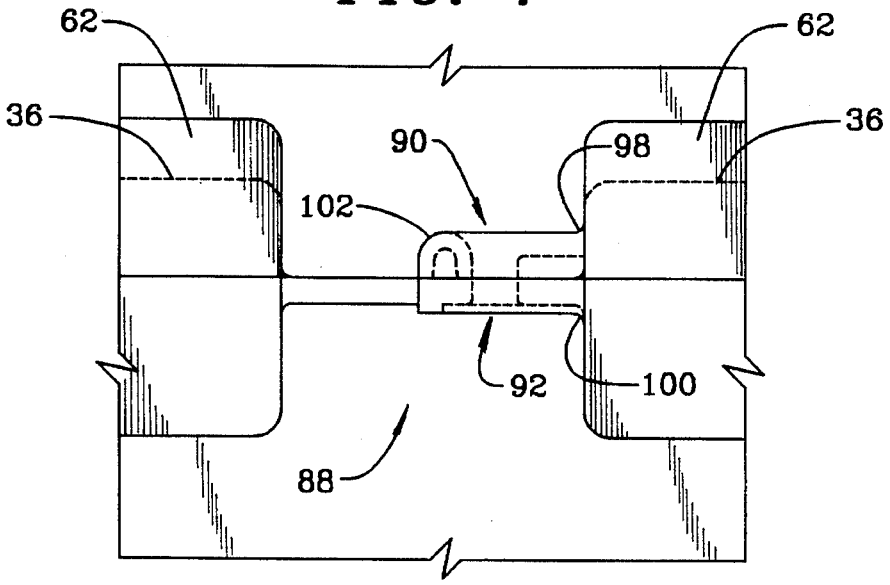
FIG. 7 is an enlarged front view of the padlock hasp of FIG. 6.

Referring to FIGS. 6 and 7, footlocker 20 preferably includes a padlock hasp 88 for enabling the lid 46 to be locked in a closed relation above the bin 22. The hasp 88 includes an upper bracket 90 and a lower bracket 92 protruding out from and being a continuously molded part of a recess respectively formed in the rim 62 and rim 34 on the front surfaces 52 and 24 of the lid 46 and the bin 22. Each bracket 90 and 92 has a respective hole 94 and 96 formed therethrough and a third structural support rib 98 and 100 formed along its outer perimeter edge providing the hasp 88 with additional strength and durability, beyond that provided by its injection molded continuous construction. A portion 102 of the upper bracket support rib 98 that runs along a side section of the upper bracket's outer perimeter edge is in the form of a U-shaped channel. When the brackets 90 and 92 are in a juxtaposed relation, such as that shown in FIG. 7, the shackle of a padlock, not shown, may be passed through and locked in each hole 94 and 96 to prevent the lid 46 from being opened and securing access to the contents in the storage cavity 32. The U-shaped portion 102 of bracket rib 98 provides even more strength to the upper bracket 90 thereby making padlock hasp 88 more durable and providing greater security for the contents of footlocker 20.

Figure 9:
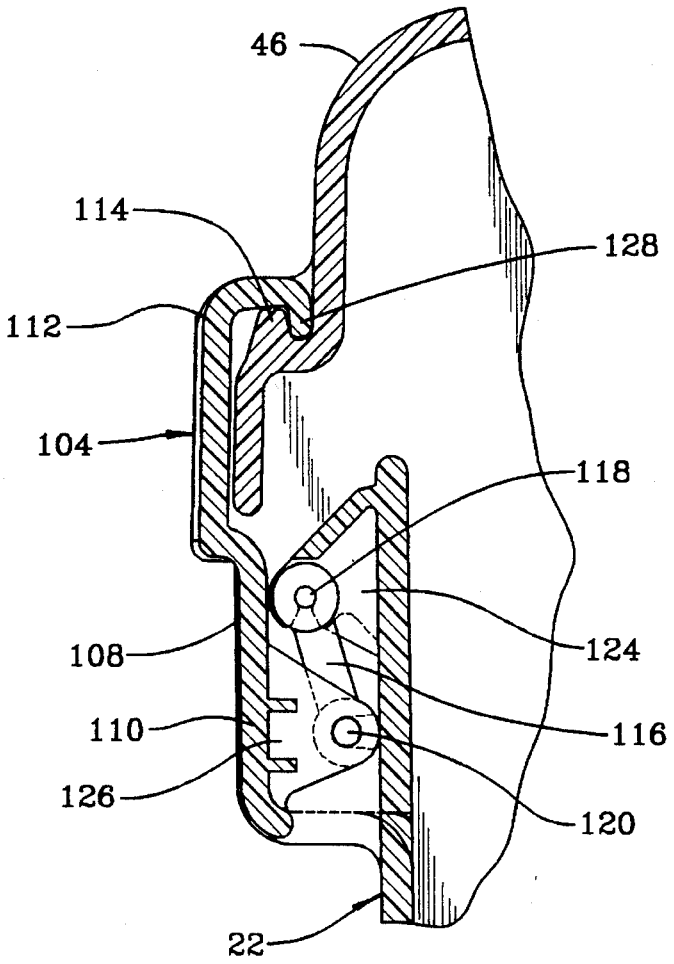
FIG. 9 is a sectional side view taken along lines 9—9 of FIG. 1.
Figure 8:
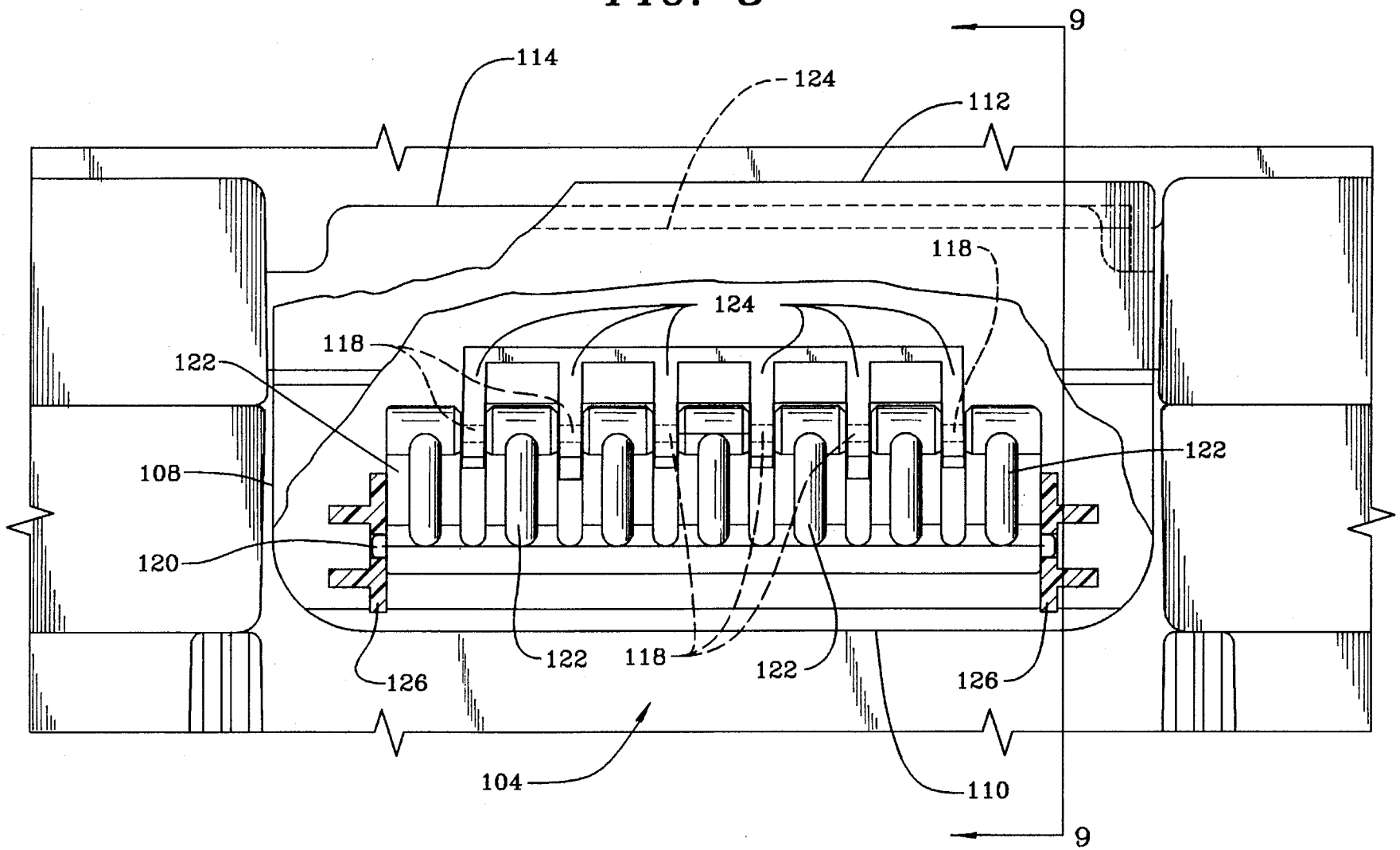
FIG. 8 is a broken away front view of one latch of the footlocker of FIG. 1.

Referring to FIGS. 1, 8 and 9, footlocker 20 further includes two injection molded plastic latches 104 and 106 disposed one on either side of the padlock hasp 88 for securing the lid 46 when closed. Each latch 104 and 106 includes a face plate 108 having a hinged end 110 pivotally connected to the front surface 24 in a recess formed in the rim 34 of bin 22. Each latch 104 and 106 also has a locking end 112 engageable with a ridge 114 formed in the front surface 52 in a recess formed in the rim 62 of lid 46. The hinged end 110 of each face plate 108 is pivotally connected to the bin 22 by a double-jointed pivot 116. The pivot 116 has a first effective pivot pin preferably in the form of a plurality of co-axial first pivot pins 118 spaced in a fixed and substantially parallel relation from a second effective pivot pin 120. Each of the first pivot pins 118 is supported between two support spacers 122 extending out from the second pivot pin 120. Each first pivot pin 118 is pivotally connected to the front surface 24 of the bin 22 by a first pivot plate 124. By having each of a plurality of first pins 118 pivotally connected to its own first pivot plate 124 and supported between two spacers 122, the strength and durability of each latch 104 and 106 is increased. The support spacers 122 are separated from each other by a gap permitting free rotation of pivot 116 in plates 124. The second pivot pin 120 has two ends pivotally connected respectively to one of two spaced second pivot plates 126 mounted to the hinged end of face plate 108. The locking end 112 of each face plate 108 has a locking lip 128 operatively adapted for being hooked behind and engaging the back of ridge 114, thereby securing the lid 46 in its closed relation to the bin 22.

Each latch 104 and 106 is released from the engaged condition shown in FIG. 9 by lifting up on hinged end 110 and lifting locking end 112 up, over and in front of ridge 114. Each latch 104 and 106 is engaged by reversing this procedure. The latches 104 and 106 have been described above as having their hinged end 110 connected to bin 22 and each ridge 114 being formed on the lid 46 for engagement by their locking end 112. However, this relationship may also be reversed so that the hinged end 110 is connected to the lid 46 and the locking end 112 engages a ridge, not shown, formed on the bin 22.

To significantly improve the aesthetic appearance and therefore the desirability of the present footlocker 20, the top surface 48 of lid 46 is formed with popular graphic indicia molded therein. This graphic indicia may be the fanciful artistic graphics shown in FIG. 1, as well as other graphics, such as sports, business or military service related graphics. The top surface 48 of lid 46 may also be provided with a centrally located and substantially flat area 132 that is raised above the balance of surface 48 and operatively adapted to receive a hot-stamp multi-colored indicia (e.g., sports, business, military or other insignia). Preferably, area 132 is provided with a #2 diamond polish finish. It may also be desirable to enhance the aesthetic appearance of the front of footlocker 20 by providing a centrally located and substantially flat area 134 on the front surface 24 of bin 22 that is operatively adapted like area 132 to receive a hot-stamp multi-colored indicia. The aesthetic appearance of footlocker 20 is further enhanced by forming each of the face plates 108 with some form of graphic indicia molded therein. Because it is molded into the lid 46 and face plates 108, the aesthetic quality of the foregoing graphic indicia lasts longer than the paint jobs used on previous footlockers (not shown). Indicia can be applied to areas 132 and 134.

From the above disclosure of the general principles of the present invention and the preceding detailed description, those skilled in this art will readily comprehend the various modifications to which the present-invention is susceptible. Therefore, the scope of the invention should be limited only by the following claims and equivalents thereof.

What is claimed is:

1. A molded plastic footlocker comprising:

a bin defined by a front surface, two side surfaces, a rear surface and a bottom surface forming a storage cavity with a first peripheral rim having an upper edge forming an opening to said storage cavity, said front surface comprising a first area for placement of personalized graphic indicia and a second area having graphic indicia molded therein, each of said side surfaces having a handle continuously molded therein adjacent to said first peripheral rim, the bottom surface of said bin having a plurality of continuously molded feet protruding there below;

a lid including a top surface, a front surface, a rear surface, two side surfaces, and a second peripheral rim, the top surface having a first area for placement of personalized graphic indicia molded therein and a second area having graphic indicia molded therein, said second peripheral rim having a groove to receive said upper edge of said bin when said lid is in a closed position;

a padlock hasp for enabling said lid to be locked in a closed position, said hasp including an upper bracket integrated into and protruding outwardly from said lid with a structural support rib formed there along, an outer perimeter edge having a side section, and a portion of the support rib of said upper bracket running along said side section being in the form of a U-shaped channel and a lower bracket integrated into and protruding outwardly from said bin, each said bracket having a hole formed therethrough, said brackets being in a juxtaposed relation suitable for allowing a shackle to be passed through each hole when said lid is in a closed relation above said bin;

a first and second hinge spaced apart, each hinge including a first hinge element formed from and protruding outwardly from the rear surface of said lid and a second hinge element formed from and protruding outwardly from a rear wall of said bin, said first and second hinge elements pivotally connected together with a hinge pin, said first and second hinge elements, respectively, being a continuously molded part of the rear surface of said lid and said bin; and a first and second latch for securing said lid in a closed position, each of said latches including a face plate having a hinged end pivotally connected to the front surface of said lid and a locking end engagable with a ridge formed in the front surface of said bin.

2. The footlocker according to claim 1, wherein said first area is substantially flat and is centrally located on its respective front surface within said second area.

3. The footlocker according to claim 1, wherein each said first hinge element includes a continuously molded first stop mechanism operatively associated with a second stop mechanism continuously molded on the rear surface of said bin when said lid is placed in an open position, said stops limiting the extent said lid can be raised.

4. The footlocker according to claim 1 including a lid stay mechanism for maintaining said lid in a raised position.

5. The footlocker according to claim 4, wherein said lid stay mechanism is further defined as a spring loaded piston positioned within a tubular housing having one end of said housing pivotally coupled to said lid and one end of said piston pivotally coupled to said bin, said spring providing a positive biasing force for lifting said lid.

6. The footlocker according to claim 5, said piston having an outer surface and a rubber O-ring operatively disposed in a groove formed in said outer surface circumferentially around said piston, said O-ring being dimensioned to extend beyond the outer surface of said piston so as to be in sufficient contact with the inner surface of said housing to generate frictional forces and pneumatic resistance as said piston moves in and out of said housing, said frictional forces and said pneumatic resistance being sufficient to lift said lid and hold said lid in an open position.

7. The footlocker of according to claim 1, wherein the hinged end of said face plate being pivotally connected to the front surface of said bin by a double-jointed pivot, said pivot having a first effective pivot pin spaced in a fixed and substantially parallel relation from a second effective pivot pin, said first effective pivot pin being pivotally connected to the front surface of said bin and said second effective pivot pin being pivotally connected to the hinged end of said latch.

8. The footlocker according to claim 1, wherein the hinged end of said face plate being pivotally connected to the front surface of said bin by a double-jointed pivot, said pivot having a plurality of coaxial first pivot pins spaced in a fixed and substantially parallel relation from a second effective pivot pin, each of said first pivot pins being pivotally connected to the front surface of one of said bin by a first pivot plate and said second effective pivot pin being pivotally connected to the hinged end of said face plate.

9. The footlocker according to claim 8, wherein each of said first pivot pins being supported between two support spacers extending out from said second effective pivot pin.

10. The footlocker according to claim 8, wherein said second effective pivot pin having two ends, each being pivotally connected respectively to said second pivot plates mounted to the hinged end of said face plate.

11. The footlocker according to claim 1, wherein said locking end includes a locking lip operatively associated with said ridge for releasable attachment thereto.

12. The footlocker according to claim 1, the top surface of said lid having a plurality of stacking depressions molded therein, each of said stacking depressions being operatively adapted to permit one of said the feet of another said bin to nest therein and enable a plurality of said footlockers to be stacked.

13. A molded plastic footlocker comprising:

a bin defined by a front surface, two side surfaces, a rear surface and a bottom surface forming a storage cavity with a first peripheral rim having an upper edge forming an opening to said storage cavity, said front surface comprising a first area for placement of personalized graphic indicia and a second area having graphic indicia molded therein, each of said side surfaces having a handle continuously molded therein adjacent to said first peripheral rim, the bottom surface of said bin having a plurality of continuously molded feet protruding there below;

a lid including a top surface, an underside surface, a front surface, a rear surface, a length, a width and a second peripheral rim, the top surface of said lid having a plurality of stacking depressions molded therein, each said stacking depression being operatively associated with one of the feet of another of said bin to nest therein and enable stacking a plurality of said footlockers, said underside surface having at least one first structural support rib running along its length and a plurality of second structural support ribs running along its width, each of said first and second ribs projecting outwardly from said underside surface, said second peripheral rim having a groove operatively adapted to receive the upper edge of said bin when said lid is in a closed relation above said bin;

a padlock hasp for enabling said lid to be locked in a closed position, said hasp including an upper bracket integrated into and protruding outwardly from said lid with a structural support rib formed there along, an outer perimeter edge having a side section, and a portion of the support rib of said upper bracket running along said side section being in the form of a U-shaped channel and a lower bracket integrated into an protruding outwardly from said bin, each bracket having a hole formed therethrough, said brackets being in a juxtaposed relation suitable for allowing a shackle to be passed through each hole when said lid is in a closed relation above said bin;

a first and second hinge spaced apart, each hinge including a first hinge element formed from and protruding outwardly from the rear surface of said lid and a second hinge element formed from and protruding outwardly from a rear wall of said bin, said first and second hinge elements pivotally connected together with a hinge pin, said first and second hinge elements, respectively, being a continuously molded part of the rear surface of said lid and said bin; and a first and second latch for securing said lid in a closed position, each of said latches including a face plate having a hinged end pivotally connected to the front surface of said bin by a double-jointed pivot, and a locking end with a locking lip operatively adapted to be hooked behind a ridge formed in a front surface of said lid, said pivot having a first effective pivot pin spaced in a fixed and substantially parallel relation from a second effective pivot pin, said first effective pivot pin being pivotally connected to the front surface of said bin and said second effective pivot pin being pivotally connected to the hinged end of said face plate.

14. The footlocker according to claim 13, wherein each said first hinge element includes a continuously molded first stop mechanism operatively associated with a second stop mechanism continuously molded on the rear surface of said bin when said lid is placed in an open position, said stops limiting the extent said lid can be raised.

15. The footlocker according to claim 13 including a lid stay mechanism for maintaining said lid in a raised position.

16. A molded plastic footlocker comprising:

a bin defined by a front surface, two side surfaces, a rear surface and a bottom surface forming a storage cavity with a first peripheral rim having an upper edge forming an opening to said storage cavity, said front surface comprising a first area for placement of personalized graphic indicia and a second area having graphic indicia molded therein, each of said side surfaces having a handle with a plurality of air vent slots continuously molded therein and recessed up into said peripheral rim, the bottom surface of said bin having a plurality of continuously molded feet protruding there below;

a lid including a top surface, an underside surface, a front surface, a rear surface, a length, a width and a second peripheral rim, the top surface of said lid having graphic indicia and a plurality of stacking depressions molded therein, and a centrally located second area having graphic indicia molded thereon, each of said stacking depressions being operatively adapted to permit one of the feet of another bin to nest therein and enable a plurality of footlockers to be stacked, said underside surface having at least one first structural support rib running along its length and a plurality of second structural support ribs running along its width, each of said first and second ribs projecting outwardly from said underside surface, said second peripheral rim having a peripheral groove operatively adapted to receive the upper edge of said bin when said lid is in a closed position;

a first and second hinge spaced apart, each hinge including a first hinge element formed from and protruding outwardly from the rear surface of said lid and a second hinge element formed from and protruding outwardly from a rear wall of said bin, Said first and second hinge elements pivotally connected together with a hinge pin, said first and second hinge elements, respectively, being a continuously molded part of the rear surface of said lid and said bin; and a padlock hasp for enabling said lid to be locked in said closed relation, said hasp including an upper bracket and a lower bracket respectively protruding out from and being a continuously molded part of the front surface of said lid and said bin, each bracket having a hole formed therethrough and an outer perimeter edge with a third structural support rib formed there along, the outer perimeter edge of said upper bracket having a side section, and a portion of the third support rib of said upper bracket running along said side section being in the form of a U-shaped channel, said brackets being in a juxtaposed relation suitable for allowing a shackle to be passed through each hole when said lid is in said closed position; and a first and second latch disposed either side of said padlock hasp for securing said lid in a closed position, each of said latches including a face plate having a front surface with graphic indicia, a hinged end pivotally connected to the front surface of said bin by a double-jointed pivot, and a locking end with a locking lip operatively adapted to be hooked behind a ridge formed in the front surface of said lid, said pivot having a first effective pivot pin spaced in a fixed and substantially parallel relation from a second effective pivot pin, said first effective pivot pin being pivotally connected to the front surface of said bin and said second effective pivot pin being pivotally connected to the hinged end of said face plate.

* * * * *